US007302890B2

(12) United States Patent
Saxby

(10) Patent No.: US 7,302,890 B2
(45) Date of Patent: Dec. 4, 2007

(54) TRAINING AMMUNITION

(75) Inventor: Michael Ernest Saxby, Bexhill-on-Sea (GB)

(73) Assignee: UTM IP Limited, Mildenhall (GB)

( * ) Notice: Subject to any disclaimer, the term of this patent is extended or adjusted under 35 U.S.C. 154(b) by 0 days.

(21) Appl. No.: 10/903,509

(22) Filed: Jul. 30, 2004

(65) Prior Publication Data

US 2005/0103221 A1 May 19, 2005

Related U.S. Application Data

(63) Continuation of application No. 10/203,551, filed as application No. PCT/GB01/00515 on Feb. 8, 2001, now abandoned.

(30) Foreign Application Priority Data

Feb. 8, 2000 (GB) ..... 0002767.2

(51) Int. Cl.
*F42B 5/32* (2006.01)

(52) U.S. Cl. ..... 102/471

(58) Field of Classification Search ..... 102/446, 102/469, 471; 42/77; 89/194
See application file for complete search history.

(56) References Cited

U.S. PATENT DOCUMENTS

| | | | | |
|---|---|---|---|---|
| 3,598,053 A | | 8/1971 | Glater | |
| 4,442,777 A | | 4/1984 | Greene | |
| 4,644,930 A | * | 2/1987 | Mainhardt | 124/58 |
| 4,955,157 A | * | 9/1990 | Brighton et al. | 42/77 |
| 5,492,063 A | | 2/1996 | Dittrich | |

FOREIGN PATENT DOCUMENTS

| | | |
|---|---|---|
| DE | 1453824 | 5/1969 |
| EP | 0377924 A1 | 7/1990 |
| GB | 1144064 | 5/1969 |
| GB | 2 341 440 A | 3/2000 |
| WO | WO-98/41810 A1 | 9/1998 |
| WO | WO-00/09965 A1 | 2/2000 |
| WO | WO-00/16032 A1 | 3/2000 |

* cited by examiner

*Primary Examiner*—T. Nguyen
(74) *Attorney, Agent, or Firm*—Lahive & Cockfield, LLP; Anthony A. Laurentano, Esq.

(57) ABSTRACT

The invention provides a training cartridge having a peripheral fire primer and a gun modified to fire the cartridge. The combination of modified gun and peripheral fire cartridge avoids the potentially adverse consequences that could arise if live ammunition and training ammunition were to become inadvertently confused or mixed up by preventing the firing of live center fire ammunition.

6 Claims, 4 Drawing Sheets

TRAINING AMMUNITION

The current application is a continuation of U.S. Ser. No. 10/203,551, filed Nov. 6, 2002 now abandoned, which claims priority from PCT/GB01/00515, filed February 2001, which claims priority from GBSN: 0002767.2, filed on Feb. 8, 2000, all naming the same inventor and the same assignee as this application, which is hereby incorporated by reference herein.

This invention relates to improved training ammunition and to a method of modifying a gun to fire the training ammunition.

BACKGROUND OF THE INVENTION

Low powered training cartridges are known, and examples of such cartridges are disclosed in PCTGB98/00620, PCT/GB99/02859, PCT/GB99/02556, GB 9819928.4 and U.S. Pat. No. 5,492,063. Training cartridges are characterized in that they impart much less energy to a projectile than a live ("killing") round. Thus, whereas a live round may impart 800 ft/lbs of energy to a bullet and a shotgun may impart as much as 1000 ft/lbs of energy to the shot, training cartridges are much less energetic. For example, the energy imparted to a projectile by a training cartridge is typically less than 5 ft/lbs and more usually less than 4 ft/lbs. The term "training cartridges" as used herein therefore refers to such low energy cartridges, unless the context indicates otherwise.

The aforementioned training cartridges typically contain only a primer and do not contain a conventional amount of propellant. Consequently, they must be carefully designed to ensure that there is sufficient energy both to recycle a weapon and eject a projectile such as a bullet. Many training cartridges, see for example the cartridges disclosed in the patent documents supra, are of the expanding type in which the body of the cartridge comprises a "piston and cylinder" arrangement. With such cartridges, part of the energy of the primer is used to force the piston and cylinder apart (i.e. expand the cartridge) and drive the rear end of the cartridge back to recycle the weapon, and part of the energy is used to discharge the projectile from the front end of the cartridge. Careful control of gas flow within the cartridge is required in order to make sure that the projectile is discharged at a consistent and appropriate velocity and that the weapon is recycled at every firing.

All (so far as the Applicants are aware) current training ammunition, and most live military ammunition, is of the centre fire variety. Exceptions are certain 0.22" (5.56 mm) rounds generally used in target shooting (and occasionally in military training) which are of the rimfire type. Live cartridges of the centre fire variety generally have a primer carried in a cup or "can" set into the rear end of the cartridge. However, with live rounds of the rim fire type (for example the 0.22" rounds referred to above) the primer is not carried in a cup or can but is held in the hollow rim of the cartridge case itself.

FIG. 1 shows a sectional elevation through the primer for a centre fire cartridge of the type typically used in live military ammunition. The primer comprises a can 2 formed from, for example, nickel plated brass, and containing a suitable pyrotechnic primer material 4. The can is held in a recess in the centre of the rear surface (not shown) of the cartridge. An anvil 6 is set into the front of the can 2 to close the can and retain the primer in place. As the anvil is inserted into the can, the protruding central part 6*a* of the anvil greatly compresses the primer to create a compressed region

4*a* which is highly sensitive to shock. The region 4*a* which is sensitive to shock has an approximate width I, and this represents the impact area for the firing pin of a centre fire weapon. Thus, a centre fire firing pin will impact against the impact area and further compress the primer between the wall of the can and the anvil thereby detonating the primer. However, it will be appreciated that the firing pin of a rimfire weapon would impact against the can outside the impact area I and hence would not detonate the primer.

Although training cartridges that are constructed to provide consistent low energy discharge of bullets are generally safe per se, safety problems can arise when live killing cartridges are inadvertently mixed with or substituted for low powered training cartridges. As stated above, all of the known existing training cartridges use centre fire type of primers which are very similar and often identical to the types of primers used in the equivalent live killing cartridge for a particular gun type. Attempts have been made to prevent confusion between the two types of cartridge by modifying the gun so that it will not fire the cartridge type usually fired from the gun, but will only fire a training cartridge. Unfortunately, this safety feature can sometimes be bypassed by using a different live cartridge type which, when chambered, fits the gun, or by using damaged live cartridges. In such circumstances, firing live cartridges rather than training cartridges can result in serious injury or death.

It is an object of the present invention to provide a solution to the aforementioned problems by preventing live killing cartridges from being fired inadvertently in place of training cartridges.

SUMMARY OF THE INVENTION

The present invention makes use of peripheral fire primers in the training cartridges, and a gun modification which allows the firing pin of the gun to strike the periphery (i.e. rim) of the primer which fires a cartridge. If any type of centre fire cartridge is fitted into the gun whilst the conversion is fitted, the firing pin cannot set off the centre fire primer as the point of impact of the firing pin is beyond the sensitive part of the centre fire primer. Thus, the present invention prevents the standard centre fire military ammunition from being fired inadvertently instead of low velocity training ammunition.

Accordingly, in one embodiment the invention provides a training cartridge having a peripheral fire primer.

The primer typically takes the form of a cup or "can" which is set into the rear end of the cartridge. The cup typically has a hollow peripheral rim in which the primer material is located, the primer material being in a compressed state and highly sensitive to shock. The primer material can thus be detonated when the peripheral rim of the can is impacted by a firing pin. This arrangement is in contrast to conventional live rimfire cartridges (i.e. 0.22" calibre) in which the primer material is located in the rim of the cartridge itself rather than the peripheral rim of a cup set into the rear of the cartridge.

The training cartridges of the invention are preferably expandable upon firing, expansion of the cartridge serving to urge a rear surface of the cartridge rearwardly against a breech block of a gun to initiate recycling of the gun.

For example, in one embodiment, there is provided an expandable training cartridge configured to enable a projectile (e.g. a bullet) to be mounted in or on a nose portion thereof, a gas passage though the nose portion providing communication between the cartridge interior and the projectile. The cartridge has valve means for controlling propellant gas flow through the gas passage to the projectile, and a movable member which upon firing is propelled rearwardly from the cartridge against a breech block of the firearm by the pressure of propellant gas within the cartridge so as to recycle the firearm. The valve means is preferably arranged to close in order to stop or substantially reduce the flow of propellant gas through the said gas passage after the projectile has been fired from the cartridge, thereby to facilitate rearwards propulsion of the movable member.

The precise nature of the training cartridge is not critical but, for example, the training cartridge can be of the general type described in any one of PCT98/00620, PCT/GB99/02859, PCT/GB99/02556 and GB 9819928.4, but with an appropriately modified primer. The diameter of the training cartridge is generally greater than the diameter (usually approximately 0.375" (9 mm)) of live 0.22" (5.65 mm) rounds although the training cartridge may carry a 0.22" (5.65 mm) bullet or projectile, and may be provided with a primer of a diameter typically associated with a 0.22" (5.65 mm) round.

In general, the primer is the only pyrotechnic material in the cartridge; i.e. there is no propellant other than the primer. The primer is such that the cartridge produces an energy of less than 4 ft/lbs, more preferably less than 3 ft/lbs, for example less than 2.5 ft/lbs, and most preferably 2 ft/lbs or less.

In another aspect, the invention provides a method of modifying a gun to prevent it from firing live ammunition but permit the firing of a rimfire primer training cartridge, which method comprises (i) replacing a centre fire firing pin with a rim fire firing pin and/or (ii) replacing a barrel of the gun such that a centre firing pin is misaligned for centre firing of the cartridge but is aligned for rim firing of the cartridge, but excluding the modification of a gun capable of firing live 0.22" (5.56 mm) cartridges by replacing the centre firing pin with a rimfire firing pin.

In a further aspect, the invention provides a method of modifying a gun to prevent it from firing live ammunition but permit the firing of a rimfire primer training cartridge other than a 0.22" (5.56 mm) calibre cartridge, which method comprises replacing a centre fire firing pin with a rim fire firing pin.

In another aspect, the invention provides the combination of a training cartridge having a rimfire primer and a gun that has been modified to fire a rimfire primer-containing training cartridge.

In a further aspect, the invention provides a peripheral fire primer for use in a cartridge as hereinbefore defined, the primer comprising a cup for setting into the rear end of the cartridge, the cup having a hollow peripheral rim containing compressed primer material.

In a further aspect, the invention provides a method of modifying a gun to prevent it from firing live ammunition but permit the firing of a rimfire primer training cartridge, which method comprises selecting a gun having a centre fire firing pin and replacing the barrel of the gun with a barrel in which the breech is offset such that the centre fire firing pin can impact against and fire the rimfire primer training cartridge but not a centre fire cartridge.

In a still further aspect, the invention provides a gun having a centre fire firing pin and a barrel in which the breech is offset such that the centre fire firing pin can impact against and fire a rimfire primer cartridge but not a centre fire primer cartridge.

Which modification is selected will depend upon the nature of the gun. For pistols or other guns which have sliding or removable barrels, a barrel conversion may offer the simplest means of modifying the weapon. On the other hand, if the barrel is fixed, and the breech block is slidable, as with most rifles and machine guns, then the simplest conversion is to modify or change the firing pin to a rimfire firing pin.

In the case of a barrel modification, the centre fire firing pin of a gun prior to modification is arranged such that it strikes at a location which is central with regard to the bore or breech of the barrel, i.e. the centre line of the firing pin is coincident with the centre line of the barrel. After modification in accordance with the invention, the centre line of the bore of the barrel is offset relative to the centre line of the firing pin. This means that a firing mechanism incorporating a centre fire firing pin will not impact against the sensitive central area of a centre fire cartridge but will instead impact against the rim. Thus, the modification to the barrel allows rimfire training cartridges to be fired but prevents the corresponding centre fire live ammunition from being detonated.

A further advantage of the offset of the bore is that the bore can be inclined with respect to the axis of the barrel thereby providing a means of correcting the trajectory of the low velocity projectile without the user of the gun needing to make any changes to his normal sighting.

In cases where it is more appropriate to modify the firing pin, rather than the barrel, the centre line of the firing pin may still be aligned with the centre line of the bore of the barrel but the modified pin typically has a laterally extended leading end portion, the laterally extended leading end portion having a leading surface profiled such that it impacts against the rim of a rimfire primer but not against the centre of a centre fire primer. The laterally extended leading end portion can be laterally extended in one plane or in two planes.

For example, when it is extended in one plane, the end of the pin can take the form of a flat spade-like structure that slides in a slot cut into the breech block. The flat spade-like structure may have one or two (and preferably two for balance) forwardly oriented projections at the edges thereof for impacting against the rim of a rimfire primer but not the central impact area of a centre fire primer.

When the leading end portion of the modified firing pin is laterally extended in two planes, it can, for example, have a cylindrical form. In such a case, the leading surface can have one or more (preferably more than one) discrete projections protruding forwardly therefrom, or the leading surface can be provided with a forwardly projecting annular rim having a diameter such that it impacts against the impact area of a rimfire primer but not the impact area of a centre fire primer.

In order to reduce still further the possibility of a centre fire primer being detonated by the modified pin (for example as a consequence of a piece of particulate matter or debris between the firing pin and cartridge), the region of the leading surface between or inwardly of the projection(s) can be cut away, at least over the area that would overlap with the impact area of a centre fire primer.

BRIEF DESCRIPTION OF THE DRAWING

The invention will now be illustrated, but not limited, by reference to the particular embodiments shown in the accompanying schematic drawings, FIGS. 1 to 9.

DETAILED DESCRIPTION OF THE PREFERRED EMBODIMENTS

Figure 1:
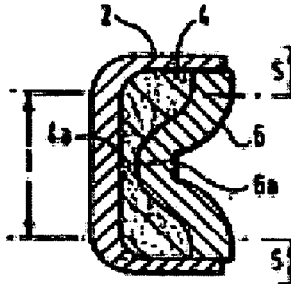
Fig.1. (Prior Art)
FIG. 1 (prior art) is a side sectional elevation through a centre fire primer.
Figure 2:
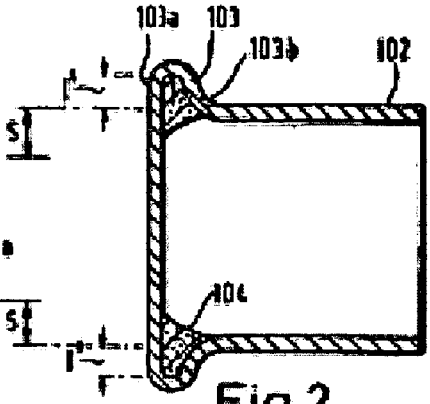
FIG. 2 is a side sectional elevation through a rimfire primer.

A peripheral fire primer for use in a cartridge according to the invention is shown in FIG. 2 and comprises a can 102, the closed end of which is formed to provide a hollow peripheral rim area 103. A pyrotechnic primer composition 104 is placed in the can and the can is spun thereby forcing the pyrotechnic material into the hollow peripheral rim area 103. With the primer of FIG. 2, the impact area I' is annular in shape and extends around the peripheral rim of the primer. As can be seen from FIGS. 1 and 2 together, for cartridges of the same calibre, there will be a dead zone S between the impact region I of a centre fire primer, and the impact region I' of a peripheral fire region in which any impact will not detonate the primer. When a cartridge containing the primer of FIG. 2 is placed in a weapon having an appropriately configured and aligned firing pin and the weapon is fired, the firing pin strikes impact area I' and compresses the pyrotechnic composition between the two walls 103*a* and 103*b* of the hollow rim region 103, the shock imparted to the pyrotechnic composition causing it to detonate.

Figure 3:
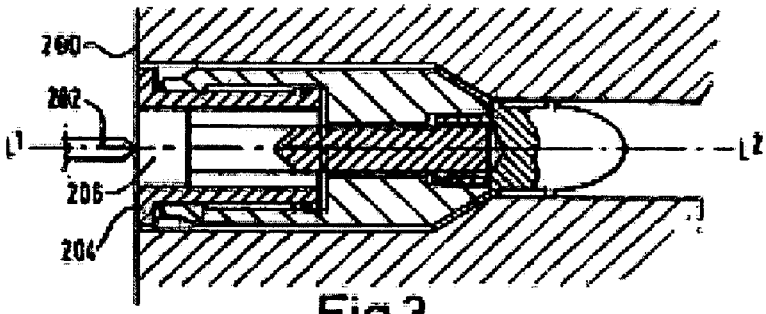
FIG. 3 is a schematic elevation of a centre fire primer in a gun fitted with a centre fire firing pin.

Referring now to FIG. 3, there is shown a conventional arrangement of a gun 200 having a centre firing pin 202, a training cartridge 204 being inserted into the breech thereof. In this case, in accordance with conventional practice, the cartridge 204 has a centre fire primer 206 fitted into the end thereof, the primer being of the type shown in FIG. 1. It will be noticed that the centre line L1 of the firing pin 202 is coincident with the centre line L2 of the barrel of the gun.

Figure 4:
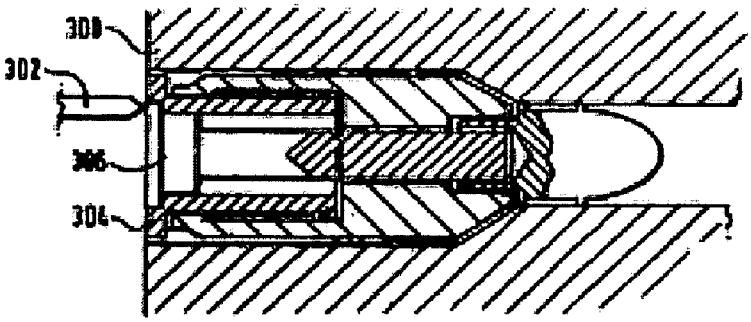
FIG. 4 is a schematic elevation of a rimfire primer in a gun fitted with a rimfire firing pin.

In FIG. 4, there is shown an arrangement in which a gun 300 has been modified to provide it with a peripheral fire firing pin 302 which is offset from the centre line of the barrel so that it can fire a training cartridge 304 having a peripheral fire primer 306 of the type shown in FIG. 2.

As indicated above, a problem with centre fire training cartridges is that on occasions training cartridges and live killing ammunition can become confused. In order to avoid this problem the invention provides a training cartridge which is detonated by impact on the peripheral rim of the primer, and makes use of a gun which is specially modified to allow use of the peripheral fire primer.

Figure 5:
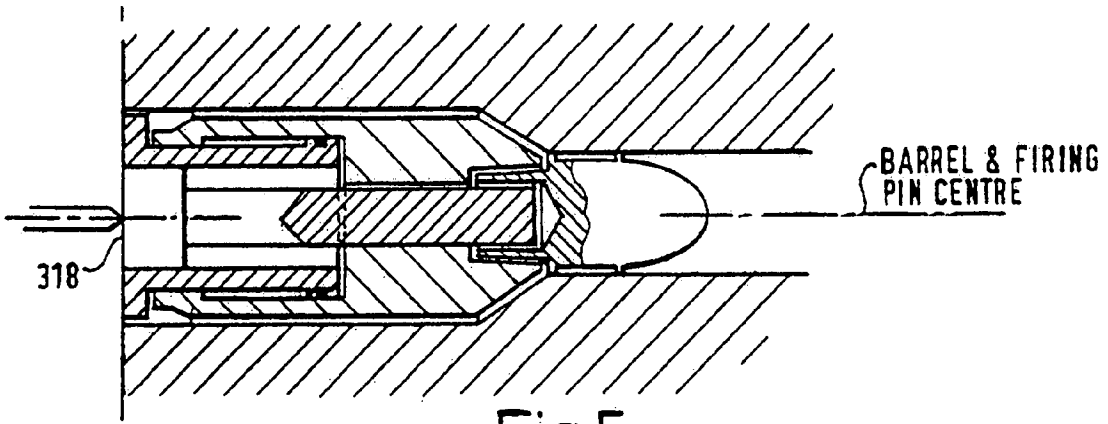
FIG. 5 illustrates schematically part of a standard centre fire pistol having a barrel containing a centre fire primer cartridge.
Figure 6:
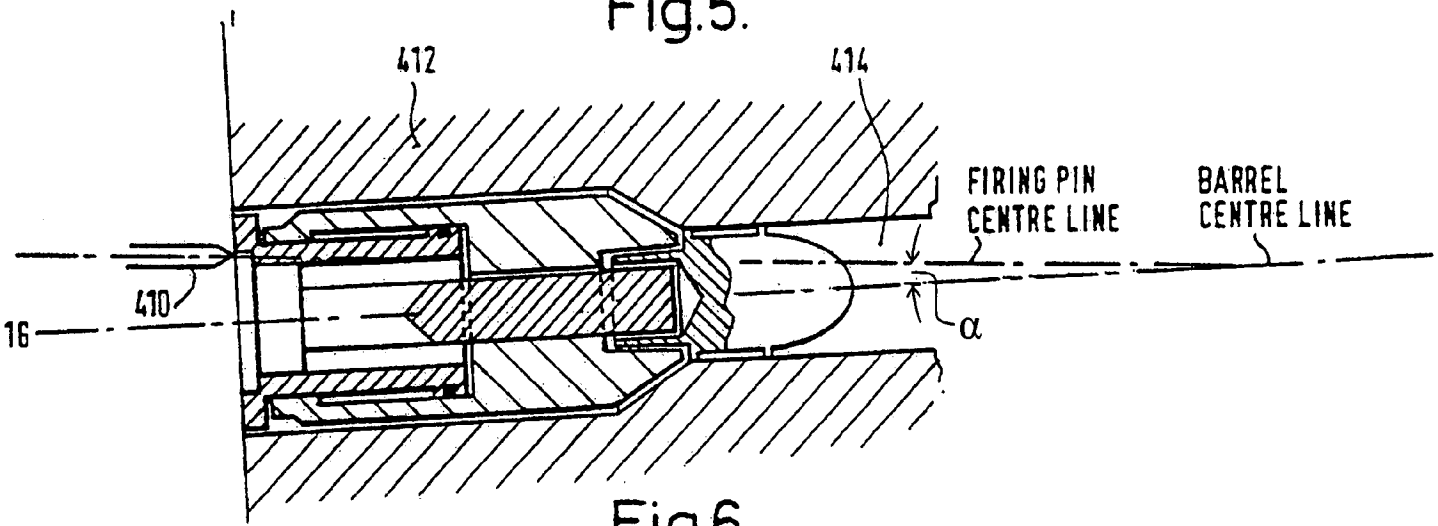
FIG. 6 illustrates schematically the centre fire gun of FIG. 5 but wherein the barrel has been replaced by a modified barrel.

FIG. 5 shows a standard centre fire pistol into which has been inserted a cartridge having a centre fire primer. The arrangement shown in this figure corresponds to FIG. 3 except that the barrel of the pistol is removable. FIG. 6 shows a modification of the gun shown in FIG. 5. As demonstrated in FIG. 6, the gun is still provided with a centre fire firing pin 410 which, with a normal gun barrel, would allow the firing of centre fire cartridges. However, in order to prevent centre fire cartridges from being fired, the gun is converted by replacing the normal gun barrel with a gun barrel 412 in which the bore 414 is offset. As can be seen from FIG. 6, the bore 414 is inclined at an angle $\alpha$ with regard to the axis 16 of the barrel. The centre line of the bore 414 is also inclined with respect to the centre line of the firing pin 410.

If a training cartridge having a peripheral fire primer is inserted into the breech, the relative geometry of the gun barrel and firing pin are such that the firing pin can fire the cartridge. On the other hand, if a centre fire cartridge (for example a live killing cartridge) is inserted into the gun barrel, the firing pin 410 will fail to strike the centre fire impact area 318, and hence the cartridge will not detonate. Thus, the modification of the invention greatly enhances the safety in that it prevents live killing ammunition from being inadvertently mixed with training ammunition.

A further advantage of the arrangement shown in FIG. 6 is that it can enable training ammunition to be used more accurately. One of the problems with training ammunition is that the low velocity means that the bullet will often fall away before it reaches a target, and consequently there will be a tendency for the user to compensate for this by aiming above the target. Thus shooting at targets using low velocity ammunition can be less realistic than is desirable. With the gun barrel arrangement shown in FIG. 6, the user of the gun can fix his sights on the target in the normal way, and the angle of the bore, rather than the angle of the barrel, provides the necessary correction to enable the projectile to reach its target. Thus, the range of the training ammunition is much closer to the range of normal live killing ammunition.

The modification shown in FIG. 6 is particularly suited to pistols since in many cases the barrel of a pistol can be removed fairly easily. However, the barrels of rifles are typically fixed and hence a barrel modification of the type shown in FIG. 6 would involve somewhat more complex alterations to the gun and would not be a practical proposition.

Figure 7:
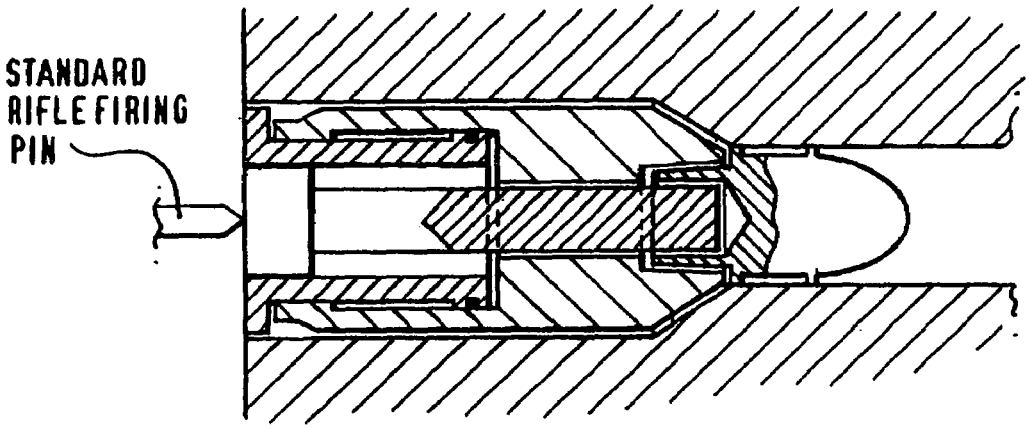
FIG. 7 illustrates a standard rifle fitted with a centre fire firing pin and containing a centre fire primer cartridge.
Figure 8:
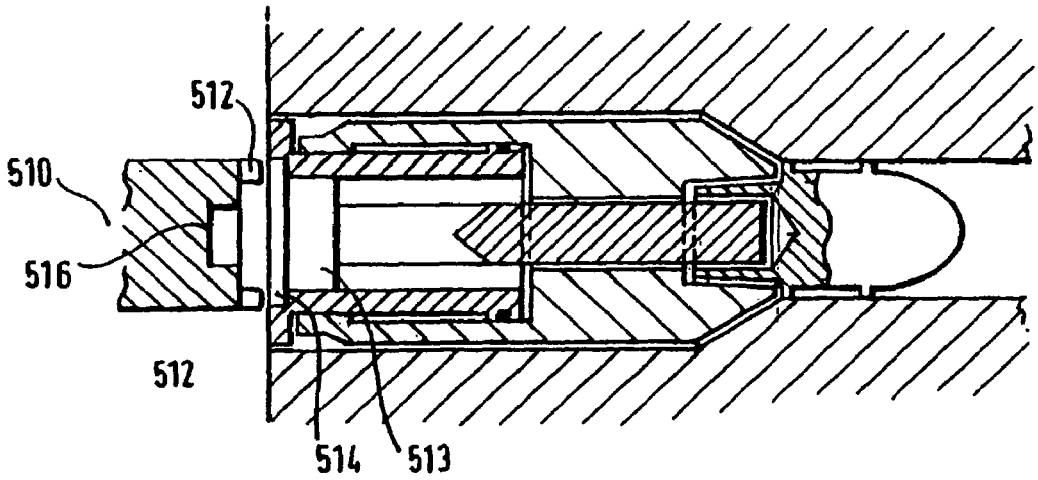
FIG. 8 illustrates the rifle of FIG. 7 but with a modified firing pin.

Therefore, with rifles and machine guns and other firearms with fixed non-sliding barrels, it is easier to modify the firing pin and this is demonstrated in FIGS. 7 and 8.

FIG. 7 shows a part of a conventional rifle equipped with a centre firing pin and having a centre fire training bullet inserted in the breech thereof. FIG. 8 illustrates the same rifle but wherein the firing pin has been modified. Thus the firing pin is no longer pin-shaped but instead has a leading end which is extended laterally to give a spade-like shape. The leading surface of the leading end has forwardly oriented projections 512 at either edge thereof, the projections being aligned with the impact region 514 of the peripheral fire primer 513 of the cartridge. The central part 516 of the leading end is recessed, the width of the recess being at least as great as the width of the impact area of the centre fire primer 318. In use, when the weapon is fired, the projections 512 on the edges of the leading end of the modified firing pin impact against the sensitive impact region of the peripheral fire primer to detonate the primer. However, if a cartridge (e.g. a live killing round) having a centre fire primer is inadvertently inserted into the gun, it will not be detonated. The safety of the modified firing pin arrangement shown in FIG. 8 is further enhanced by virtue of the recessed central region 516 which ensures that centre fire primers cannot accidentally be detonated as a result of the presence of particles of debris between the firing pin and cartridge.

The modified firing pin of FIG. 8 can be fitted, for example, by shortening an existing firing pin, cutting a thread on the end thereof, and fixing the threaded end into a suitably profiled end piece. The circular channel or opening in which the firing pin normally slides is machined out to form a slot to accommodate the spade-like shape of the end piece.

Figure 9:
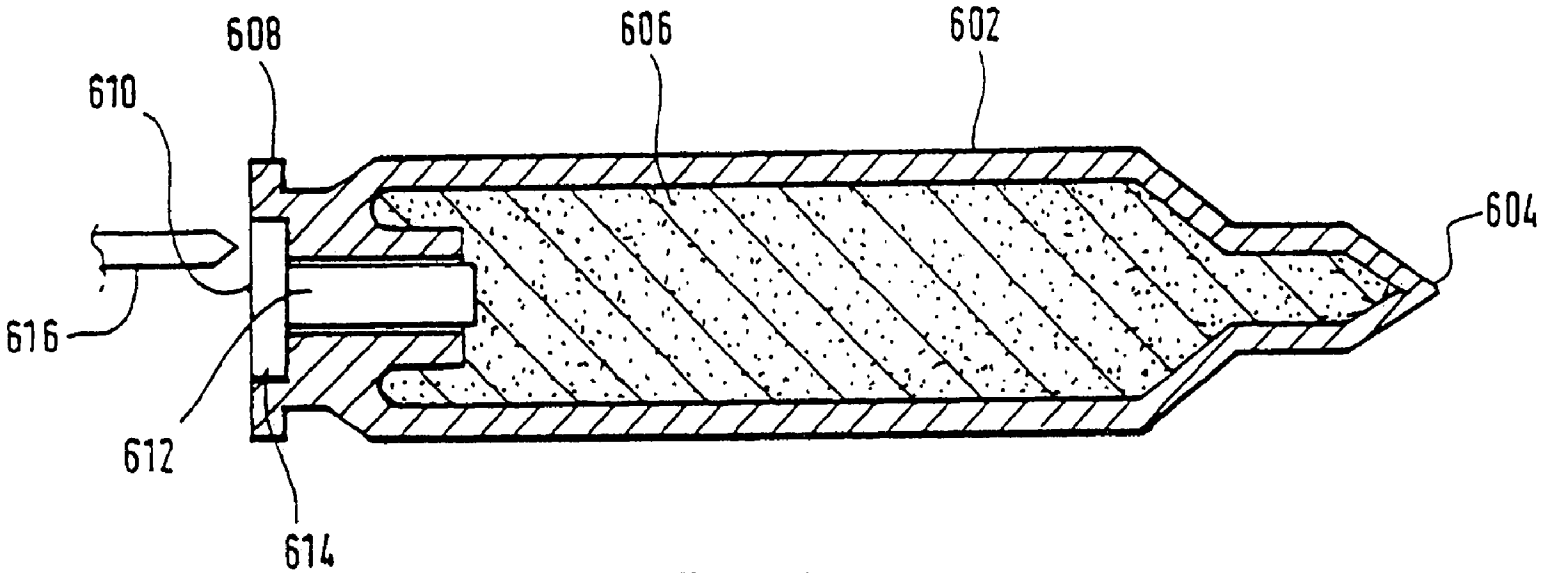
FIG. 9 illustrates an explosive blank cartridge having a peripheral fire primer.

FIG. 9 illustrates an explosive blank cartridge that can be fired in the modified gun of FIG. 8. The blank cartridge comprises a casing 602 closed at its nose 604 and containing an explosive material 606. The rear end of the blank cartridge has a flange 608 to enable the spent cartridge to be extracted from the breech in the usual manner. Thus far, the blank cartridge is of conventional construction. However, the cartridge differs from conventional blank cartridges in that the primer 610 set into the centre of the rear of the cartridge is a peripheral fire primer. The primer 610, which can be of the form shown in FIG. 2 or an appropriate modification thereof, comprises a cup or can 612 having a hollow peripheral rim 614 containing compressed primer material. In use, the off centre firing pin 616 of the gun impacts against the peripheral rim 614 thereby detonating the primer material which in turn detonates the explosive material 606. Expanding gases created by the detonation of the primer and explosive material burst through the nose 604 in the usual manner to give a realistic bang.

The foregoing examples illustrate merely some of the ways in which the invention can be put into effect, and it will readily be apparent that numerous modifications and alterations can be made to the arrangements shown in the accompanying drawings without departing from the principles underlying the invention. All such modifications and alterations are intended to be embraced by this application.

The invention claimed is:

1. A modified training ammunition system having a combination of a gun with a center firing pin and a center fire primer and one or more training cartridges having a peripheral rimfire primer, in which the modification comprises the replacement of the center fire firing pin of the gun with a rimfire firing pin and thereby causes the rimfire firing pin to strike only at the periphery of the rimfire primer and prevents the training system from firing live ammunition with the centre fire primer but permits firing of the one or more rimfire primer of the training cartridges when the rimfire firing pin strikes the rimfire primer.

2. A combination as claimed in claim 1 wherein the one or more training cartridges have a rear end into which a rimfire primer cup is set.

3. A combination as claimed in claim 1 wherein the one or more training cartridges is expandable upon firing, expansion of the one or more cartridges serving to urge a rear surface of the one or more cartridges rearwardly against a breech block of the modified gun to initiate recycling of the gun.

4. A combination as claimed in claim 1 wherein the rimfire firing pin has a flat spadelike structure formed on an end thereof and having one or more forwardly oriented projections, the projections being located at edges of the end of the rimfire firing pin such that the one or more projections at the end of the rimfire firing pin strike an impact area of the rimfire primer but not an impact area of a center fire primer.

5. A combination as claimed in claim 1 wherein the rimfire firing pin has a cylindrical form with one or more projections extending outwardly therefrom, wherein the one or more projections are disposed at a diameter such that the one or more projections strike an the impact area of the rimfire primer but not an, impact area of a center fire primer.

6. A combination as claimed in claim 1 wherein the rimfire firing pin has a cylindrical form with a hollow annular profile at one end to form a bellow end, the hollow end having an inner diameter such that the rimfire firing pin strikes an impact area of the rimfire primer with the hollow end, but not an impact area of a center fire primer.

* * * * *